US005348241A

United States Patent [19]

Huette

[11] Patent Number: 5,348,241

[45] Date of Patent: Sep. 20, 1994

[54] ROMEX WIRE DISPENSER

[76] Inventor: Dennis M. Huette, 916 S. Linden, Normal, Ill. 61761

[21] Appl. No.: 68,656

[22] Filed: May 27, 1993

[51] Int. Cl.[5] ..... B65H 49/00; B65H 75/30

[52] U.S. Cl. ..... 242/597.5; 242/129; 242/597.7; 242/604; 242/611

[58] Field of Search ..... 242/106, 129, 96, 99, 242/86

[56] References Cited

U.S. PATENT DOCUMENTS

| | | | |
|---|---|---|---|
| 1,908,073 | 5/1933 | Spoor et al. | 242/129 |
| 3,319,906 | 5/1967 | Atkinson | 242/106 |
| 3,731,888 | 5/1973 | Cassel et al. | 242/129 |
| 3,880,378 | 4/1975 | Ballenger | 242/54 R X |
| 3,974,980 | 8/1976 | Marcell | 242/129 X |
| 4,003,528 | 1/1977 | Booze | 242/106 |
| 4,277,035 | 7/1981 | Gaski | 242/129 X |
| 4,765,560 | 8/1988 | Branback | 242/129 |
| 4,844,376 | 7/1989 | Maraman | 242/129 |
| 4,856,729 | 8/1989 | Maraman | 242/129 |
| 5,033,690 | 7/1991 | McIver | 242/106 X |

*Primary Examiner*—John M. Jillions

[57] ABSTRACT

A Romex wire dispenser for use by the building trade in constructing buildings. The coiled cable usually packaged in 250 foot rolls is centrally located on rotatable radius bars. A spindle mounting assembly pivotally supports the radius bars at one end and contains a pair of spaced apart U-shaped members attached to each other by cantilever arms at the other end. The U-shaped members are adapted to fit over opposite sides of a conventional two by four stud member which are usually located 16 inches on center. The cable is dispensed from the periphery of the coil through a wire guide assembly that is pivotally attached to the spindle mounting assembly below said rotatable radius bars. The rotatable radius bars are frictionally restrained thereby allowing the construction worker to pull a selected amount of wire from the rotatable radius bars.

2 Claims, 4 Drawing Sheets

ROMEX WIRE DISPENSER

This invention relates to a Romex wire dispenser for use by the building profession in wiring the building under construction and more particularly to a reel for dispensing a non-metallic sheet cable of the type known under the trade name ROMEX.

Wiring cable of the type used in conventional building construction is usually sold in coiled lengths of 250 feet that are individually packaged in corrugated cardboard containers. Larger diameter wires capable of carrying a higher current would of necessity be contained in a larger carton whereas smaller diameter wires having the same 250 foot length would be contained in a smaller sized carton.

The usual practice in the building profession is to locate the coiled cardboard container containing the 250 foot length of wire at the building site for the availability of the wiring electrician. The cardboard container is usually sliced open and one end of the coiled wire is made available for the electrician in pulling the wire through the studs from junction box to receptacle.

The wire is usually left within the container as a means of restraining the coiled wire when not in use. Unfortunately when the electrician pulls the wire from the cardboard container the wire being dispensed tends to loop upon itself causing kinks and bends due to the looping of the wire as the wire is uncoiled. This looping of the wire requires constant attention having the tendency to slow the work of the electrician or at best requires an electrician and a helper to continually unwind the dispensed wire so that the wire may pass freely through the studs under the urging of the electrician.

This invention describes a Romex wire dispenser that freely dispenses the coiled wire from the periphery of the coil under the urging of the electrician and without the aforementioned kinks and loops. The dispenser is adapted to be movably mounted on a conventional 2×4 stud and also can be mounted from overhead joists by attached carrying handle 20 insuring that the coiled wire will be located as close to the work as possible thereby reducing effort and saving time of the installation.

The Romex wire dispenser contains rotatable radius bars adapted to accept a complete 250 foot reel of coiled wire. The coiled wire is first completely removed from the cardboard shipping container and placed upon the rotatable radius bars. The bars are rotatably mounted upon a spindle mounting assembly that is fixedly attached to an arm connecting a pair of spaced apart U-shaped members. The U-shaped members are each adapted to fit over opposite sides of a 2×4 stud member to hold spindle mounting assembly in a given position when hooked over a stud member.

In the usual embodiment the spindle mounting assembly is shaped to hold the rotatable radius bars in a horizontal plane with the spaced apart U-shaped members located about a vertical stud member.

A cable guide assembly having a length greater than the diameter of the rotatable radius bars is pivotly mounted at one end on the spindle mounting assembly and below the rotatable radius bars 45. The other end of the cable guide assembly is formed into an open circle 50 for accepting and guiding the dispensing cable. In this manner the electrician has only to slip the cable through the open circle 50 and regardless of his location in the room relative to the supporting stud member the cable will be dispensed through the circle 50 opening located on the cable dispensing assembly. In other words regardless of where the electrician is located the circle 50 end of the cable guide assembly will always be facing the electrician and the wire will be dispensed without kinks or bends.

In order to prevent spilling of wire which may result from a free-wheeling reel or from over-pulling on the wire by the electrician there is located a brake member in the form of a compression spring between the spindle mounting assembly and the rotatable radius bars and the cable guide assembly 55. The compression spring continuously urges the members against each other thereby restraining the rotation of the Romex unless the wire is actively being pulled by the electrician. In addition the rotatable radius bars contain a lip on the radius bars for preventing excess wire from being spilled off 45 as a result of the electrician suddenly pulling on the free end of the cable.

Further objects and advantages of the present invention will be made more apparent by referring now to the accompanying drawing wherein.

Figure 1:
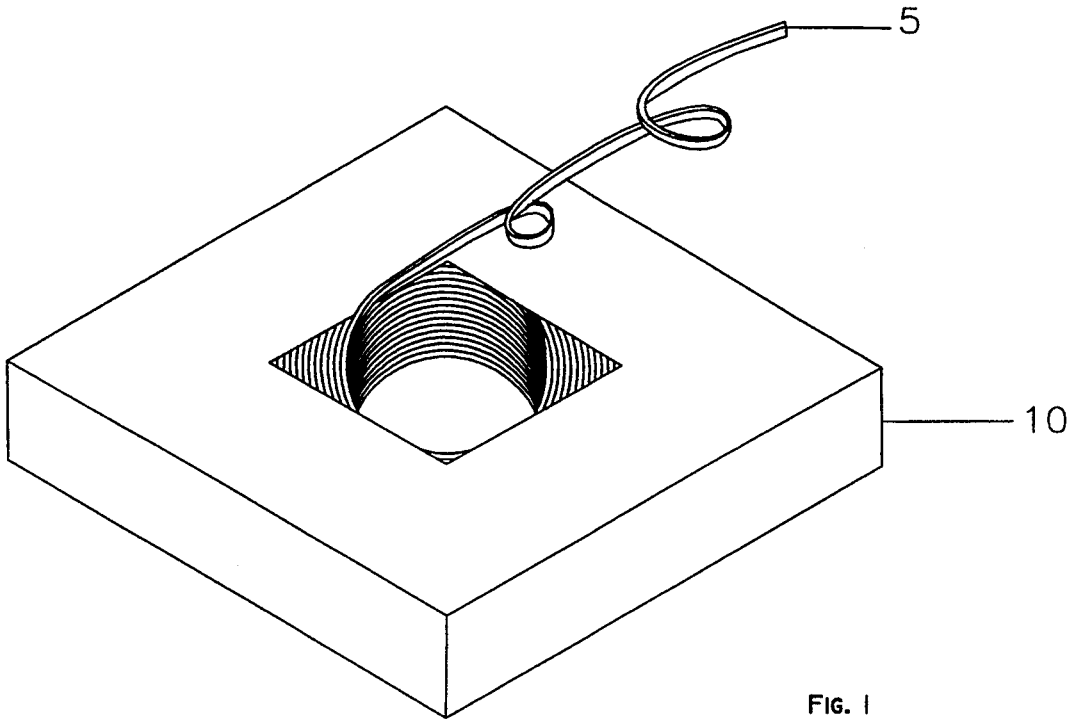
FIG. 1 is a view which illustrates the present day technique for dispensing coiled wire from the corrugated shipping container 10.

Referring now to FIG. 1 there is shown a corrugated carton 10 of the type used to ship a coiled roll of 250 feet of wire. The container is usually brought to the building site and the top section cut open as shown and the available end 5 of the wire is pulled out as needed. Due to the coiled action of the wire pulling on the end 5 produces kinks and bends as illustrated due to the unwinding of the wire. These kinks and folds can be prevented by carefully unwinding the wire which of necessity requires that a helper be located at the site of the wire in order to assist the electrician as the wire is pulled from the box. It is considered most desirable to leave the coiled wire in the corrugated carton in order to prevent spilling of the wire when less than the complete roll is used for any given installation. In addition the carton provides a convenient means of moving the coiled wire from location to location during the construction process.

Figure 2:
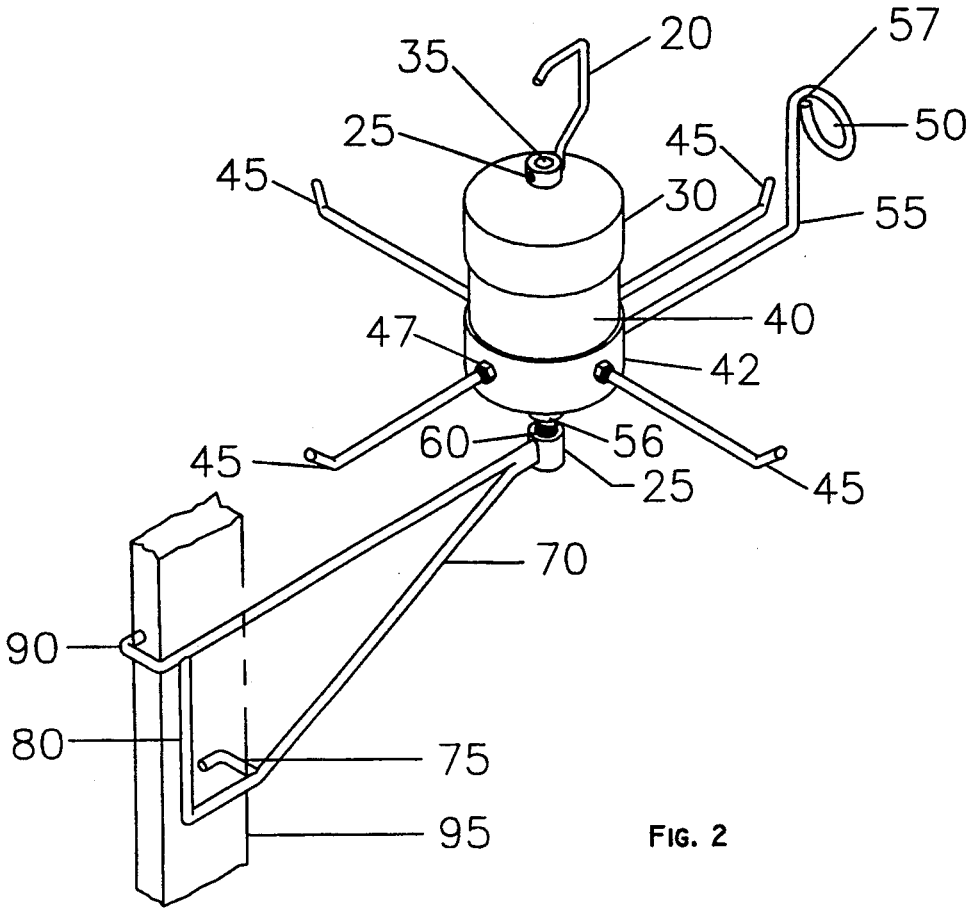
FIG. 2 is a view which illustrates a Romex wire dispenser constructed according to the teachings of the present invention mounted upon a conventional 2×4 stud member.
Figure 3:
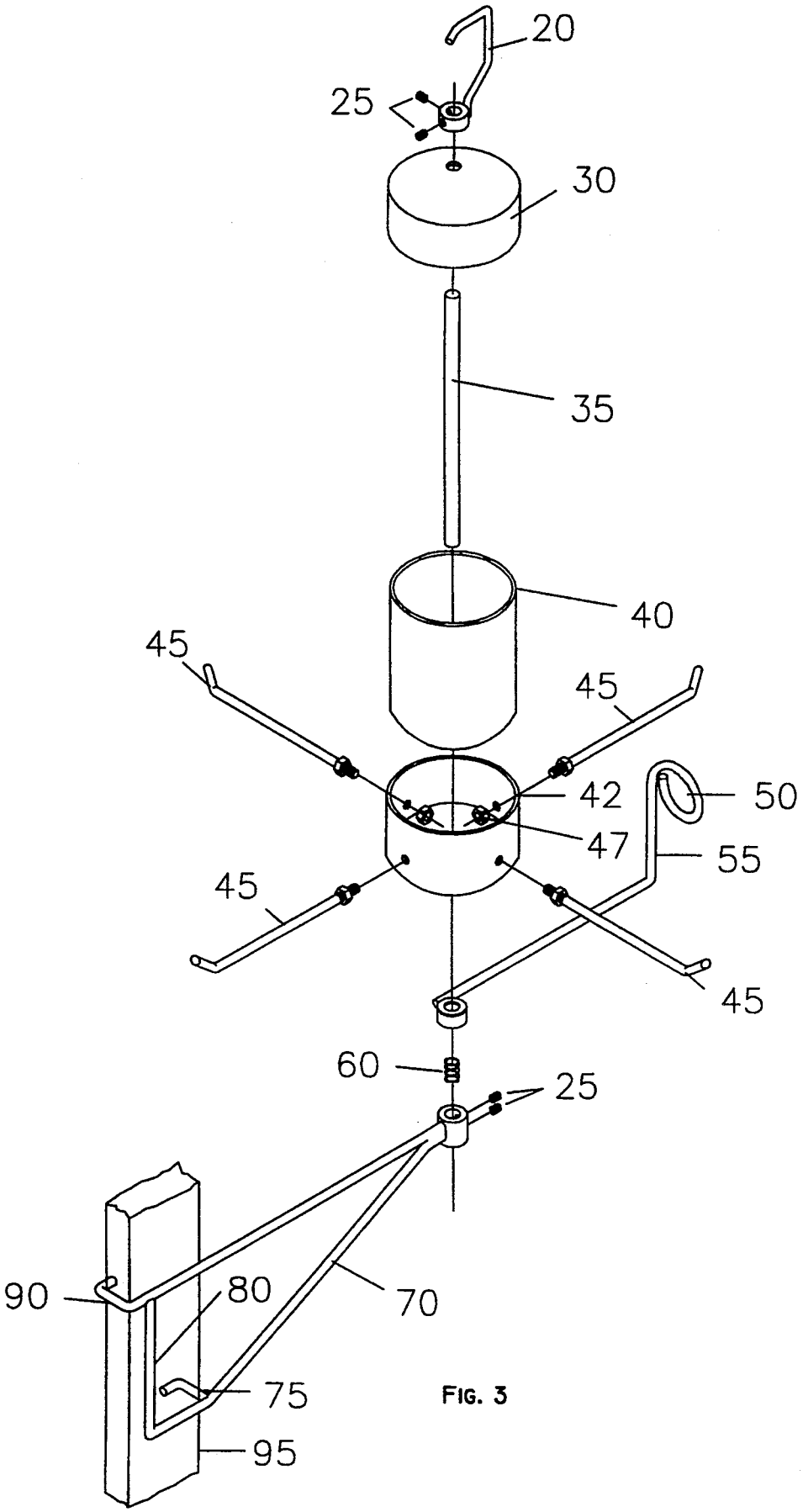
FIG. 3 is an exploded view of the dispenser shown in FIG. 2.

Referring now to FIG. 2 there is shown a Romex wire dispenser constructed according to the teachings of the present invention. Rotatable radius bars are pivotly mounted on and supported by one end of a spindle mounting assembly which is connected at the other end to a cantilever arm 70.

A pair of spaced apart U-shaped members 75 and 90 are each fixedly attached to each other by means of the arm 80. The spaced apart U-shaped members 75 and 90 are each adapted to fit over opposite sides of at least one-half of a stud member 95. In the usual building construction, 2 inch×4 inch stud members are used 16 inches on center to form the basic building wall structure. The coupling forces generated by the U-shaped members and 6 as a result of the total weight of the structure transmitted to the arm 70 allows the Romex wire dispenser to be arbitrarily located at any height above the floor level as determined by the needs of the user. The arm 70 is preferably connected to the U-shaped members 75 and 90 at the end portions of the brackets so that the arm is aligned with the stud member and preferably along the center of the widest face of the stud member.

A cable guide assembly 55 having a length greater than the diameter of the rotatable radius bars 45 are pivotably mounted at one end 55 to the spindle mounting assembly 70 and at the other end is formed into an open circle 50 for accepting the wire 5. The circle 50 is open at point 57 in order to allow the wire 5 being pulled from the coiled cable 6 to be quickly inserted within the circle. The opening 57 is situated on the uppermost portion of the circle 57 thereby insuring that the wire 5 will remain within the circle during normal use of the dispenser.

Figure 4:
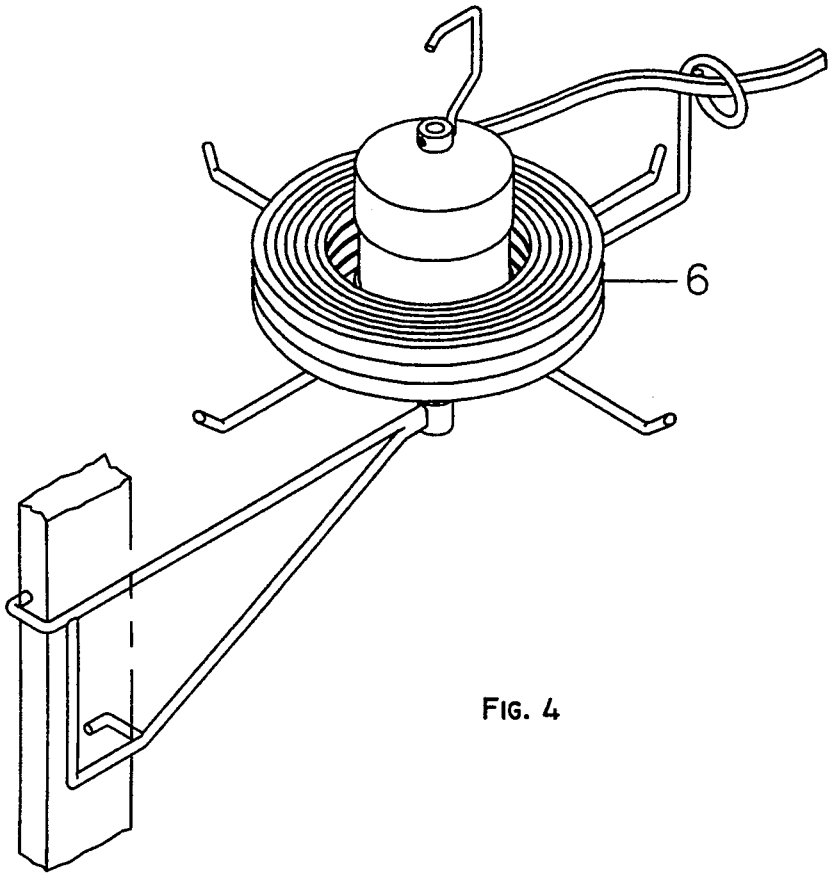
FIG. 4 is a perspective view of the dispenser with a coil of cable thereon.

Referring to FIG. 4 Romex coil 6 mounted on Romex dispenser.

In using the present invention the corrugated carton 10 as illustrated in FIG. 1 is completely opened thereby allowing the coiled cable 6 to be removed and placed upon the rotatable radius bars 45. The coiled wire 6 is centrally located and supported upon the rotatable radius bars 45 by means of a cylinder shaped reel 40. The hub members 30 and 42 have a height that is greater than the width of the largest coil of 250 foot length wire 5 that would be used on the rotatable radius bars 45. In this fashion the hub members 30 and 42 not only locate the coiled wire 5 on the rotatable radius bars 45 but also maintains the coil on the rotatable radius bars against the action of the electrician pulling upon the wire as a demand for wire is made.

In actual practice the Romex wire dispenser is located on a stud member 95 that is in close proximity to the location of the wiring needs of the electrician. As the electrician pulls on end 5 for a length of wire the cable guide assembly 55 pivots about 35 thereby aligning the circle opening 50 with the location of the electrician. In this fashion a tug on end 5 will cause the rotatable radius bars 45 to rotate while the hub members 30 and 42 maintain the coiled wire 5 on the rotatable radius bars. In this fashion the electrician may select any given length of wire and at any location in the room area without fear of kinking or folding of the wire being dispensed.

Referring now to FIG. 2 there is shown a side view of the Romex wire dispenser without the coiled wire 5 in place in order to illustrate a friction member in the form of a compression spring 60 that is located on the spindle mounting assembly 35. The compression spring 60 forces the rotatable radius bars 45 and the cable guide assembly 55 against the spindle mounting assembly 35 thereby impeding the rotation of the bars and the guide assembly so as to insure against spilling of the wire in the event a quick or sudden pull is made upon the free end of the wire.

FIG. 2 shows a section of the spaced apart U-shaped members 75 and 90 for more fully illustrating members 75 and 90 located on the U-shaped members, respectively.

I claim:

1. A Romex wire dispenser comprising, a pair of spaced apart U-shaped members, a cantilever arm and rotatable radius bars, said pair of spaced apart U-shaped members fixedly attached to each other by said cantilever arm and each adapted to fit over opposite sides of at least one-half of a building stud member, a spindle mounting assembly fixedly attached at one end to said cantilever arm and at the other end adapted to pivotally support said rotatable radius bars, said spindle mounting assembly having a specific shape for holding said rotatable radius bars in a preferred position, a cable guide assembly having a length greater than the diameter of said rotatable radius bars is pivotably mounted at one end on said spindle mounting assembly below said rotatable radius bars, said cable guide assembly being freely pivotable in all directions for dispensing cable below and above said rotatable radius bars, and a hub assembly centrally located on said rotatable radius bars for holding and controlling the positioning of a coiled spool of cable on said rotatable radius bars.

2. A Romex wire dispenser according to claim 1 which includes a brake member centrally located on said spindle mounting assembly for frictionally engaging said cable guide assembly and said rotatable radius bars to thereby impede rotational movement.

* * * * *